US005127350A

United States Patent [19]

Okada et al.

[11] Patent Number: 5,127,350

[45] Date of Patent: Jul. 7, 1992

[54] METHOD AND APPARATUS FOR CUTTING COVER THREAD IN A MULTI-NEEDLE SEWING MACHINE

[75] Inventors: Koichi Okada; Yoshikazu Kageyama; Takashi Ichimura, all of Osaka, Japan

[73] Assignee: Pegasus Sewing Machine Mfg. Co., Ltd., Osaka, Japan

[21] Appl. No.: 543,165

[22] Filed: Jun. 25, 1990

[30] Foreign Application Priority Data

Jun. 27, 1989 [JP] Japan ..... 1-166013
Jan. 24, 1990 [JP] Japan ..... 2-5956[U]

[51] Int. Cl.[5] ..... D05B 65/00

[52] U.S. Cl. ..... 112/286; 112/163; 112/295; 112/266.1

[58] Field of Search ..... 112/285, 286, 253, 293, 112/295, 165, 262.1, 197, 163, 294, 266.1, 266.2

[56] References Cited

U.S. PATENT DOCUMENTS 3,424,115 1/1969 Schopf ..... 112/165
3,584,589 6/1971 Pirrello ..... 122/295
3,998,172 12/1976 Marforio ..... 112/293
4,450,781 5/1984 Wickers et al. ..... 112/262.1
4,553,492 11/1985 Jurgens ..... 112/197

FOREIGN PATENT DOCUMENTS 3531595 3/1987 Fed. Rep. of Germany ..... 112/285
0055286 3/1984 Japan ..... 112/285
1045796 3/1986 Japan ..... 112/285

*Primary Examiner*—Werner H. Schroeder
*Assistant Examiner*—Ismael Izaguirre
*Attorney, Agent, or Firm*—Flynn, Thiel, Boutell & Tanis

[57] ABSTRACT

A cover thread cutter for a multi-needle sewing machine, the hook of the thread cutter retracts at an oblique angle above a curved cover thread laying finger and captures the cover thread at a position above the curved cover thread laying finger. While pulling the captured cover thread up to the cutting position, it is held against a specified needle, as in ordinary seam forming, and the thread end is held in this state after being cut off.

7 Claims, 6 Drawing Sheets

METHOD AND APPARATUS FOR CUTTING COVER THREAD IN A MULTI-NEEDLE SEWING MACHINE

BACKGROUND OF THE INVENTION

1. Field of the Invention

The present invention relates to a method and apparatus for cutting a cover thread of a multi-needle sewing machine which uses a cover thread.

2. Description of the Related Art

A device for automatically cutting the cover thread afler the needle thread seam at the end of sewing, is known.

Among the known devices, as disclosed in Japanese Laid-open Patent Sho. 57-128195, Utility Model Sho. 58-177086, Patent Sho. 59-55286, and Utility Model Sho. 60-179282, at the end of sewing, when the needle and feed dog reach the top end point and the curved cover thread layer finger stops at the left dead center, the cover thread, extending from the right needle thread seam at the end of sewing to the hook of the curved cover thread laying finger, is captured and cut by the hook of the thread cutter, which reciprocates at an oblique angle from the left rear side of the left needle or the right operator side of the left needle. The cut end of the cover thread at the cut-off thread supply source side is directly clamped in the thread cutter, and is caught by a specified needle or captured by the curved cover thread laying finger when starting the next sewing work, so as to be securely sewn into the first needle thread seam. As disclosed in the Japanese Laid-open Patent Sho. 61-45796, at the end of sewing, when the needle and feed dog stop at the bottom end point and the finger stops at the right end point, the cover thread, extending from the right needle thread seam at the end of sewing into the cover thread guide above the finger, is captured and cut by the hook of the thread cutter which reciprocates at an oblique angle from the right rear side of the right needle. The cut end of the cover thread is directly clamped in the thread cutter, so as to be captured by the finger when starting the next sewing work.

In all these conventional machines, however, since the cover thread is designed to be captured as the hook of the thread cutter advances into the space between the top surface of the presser foot and the curved cover thread laying finger, the spacing between the top surface of the presser foot and the curved cover thread laying finger becomes narrow in the case of a thick fabric, so that the hook of the thread cutter may not get in easily.

These conventional thread cutters are composed of a fixed cutter, a hook of the thread cutter which moves in and out sliding on the fixed cutter, and a leaf spring for pressing the hook to the fixed cutter. The cover thread, captured by the hook, is pulled to the fixed cutter and is cut off by the cutter, and the cut end of the cover thread at the cut-off thread supply source side is pinched and held by and between the hook and the leaf spring. In such devices, however, although it is advantageous that the hook is tightly pressed to the fixed cutter by intensifying the spring pressure of the leaf spring to cut the thread securely, the holding force on the cut thread end increases, and the thread end may not easily slip off from the hook and leaf spring when starting the next sewing work, which may lead to uneven pulling of the cloth or breakage of the needle.

Although it is not a thread cutter for a cover thread, a device having a leaf spring for holding the thread end by lightly and elastically contacting with the hook for the thread cutter, and a leaf spring for pressing the hook to the fixed cutter, is known. An example of this type is shown in the Japanese Utility Model Publication Sho. 63-10149. According to this device, the thread may be securely cut off by properly adjusting the spring pressures of individual springs, and the cut thread end may be lightly held with the minimum pressing pressure required. However, since the leaf spring is of the cantilever type, and its free end is pressed to the hook of the thread cutter, the leaf spring must be long enough to lightly and elastically contact with the hook of the thread cutter when the leaf spring is holding the thread end, and the design is not compact. In this type, the contact area with the hook is small and the holding force is lowered, so that the thread end holding is unstable, and it is always necessary to adjust the spring force.

SUMMARY OF THE INVENTION

Present invention captures the cover thread above the curved cover thread laying finger so that the cover thread may be easily and securely captured, even when a thick fabric is being sewn. In this case, when starting the next sewing work, the thread end of the cut cover thread must be held so that the curved cover thread laying finger may securely capture the cover thread.

It is therefore a primary object of the invention to present a method of capturing the cover thread above the curved cover thread laying finger by the hook of the thread cutter, and holding the cover thread securely by the curved cover thread laying finger when starting the next sewing work to cause the cover thread to be sewn into the first seam, thereby preventing skipping of the seam.

To achieve the above object, at the end of sewing, the hook of the thread cutter is designed to retract at an oblique angle from the cutting position behind the left side of the left needle to capture the cover thread above the curved cover thread laying finger and pull up to the cutting position, so as to cut off and hold the thread end. According to the invention, since the hook of the thread cutter retracts to above the curved cover thread laying finger, the cover thread can be captured, regardless of the thickness of the fabric. The captured cover thread passes through between specified needles when the hook of the thread cutter retracts at an oblique angle behind the left side of the left side needle, and is held against the left side needle used in forming the next first seam and maintained in this state even after being cut off. Therefore, when starting the next sewing work, same as at the time of usual seam forming, the cover thread is captured by the curved cover thread laying finger and is sewn into the first needle thread seam, so that a skipped stitch does not occur.

In this method, as in ordinary seam forming, the cover thread is maintained in an extended state from the left side to the cover thread guide through the rear side of the right side needle. Therefore, when starting the next sewing work, the cover thread is securely sewn into the first needle thread seam.

It is another object of the invention to present a thread cutter in a compact design by using a spring for holding the thread, instead of a leaf spring, in addition to the spring for pressing the hook of the thread cutter to the fixed cutter, so that the cut thread end may be securely held with a proper pressing pressure and that the thread may slip off easily when starting the next sewing work.

To achieve the above object, the invention presents a thread cutter having a spring device comprising a coil spring and a spring retainer, wherein the cut end of the cover thread is held by the spring device with a weaker spring force than the spring pressing the hook of the thread cutter to the fixed cutter.

Other objects and features of the invention will be better understood and appreciated from the following detailed description taken in conjunction with the accompanying drawings.

DESCRIPTION OF THE PREFERRED EMBODIMENT

Figure 1:
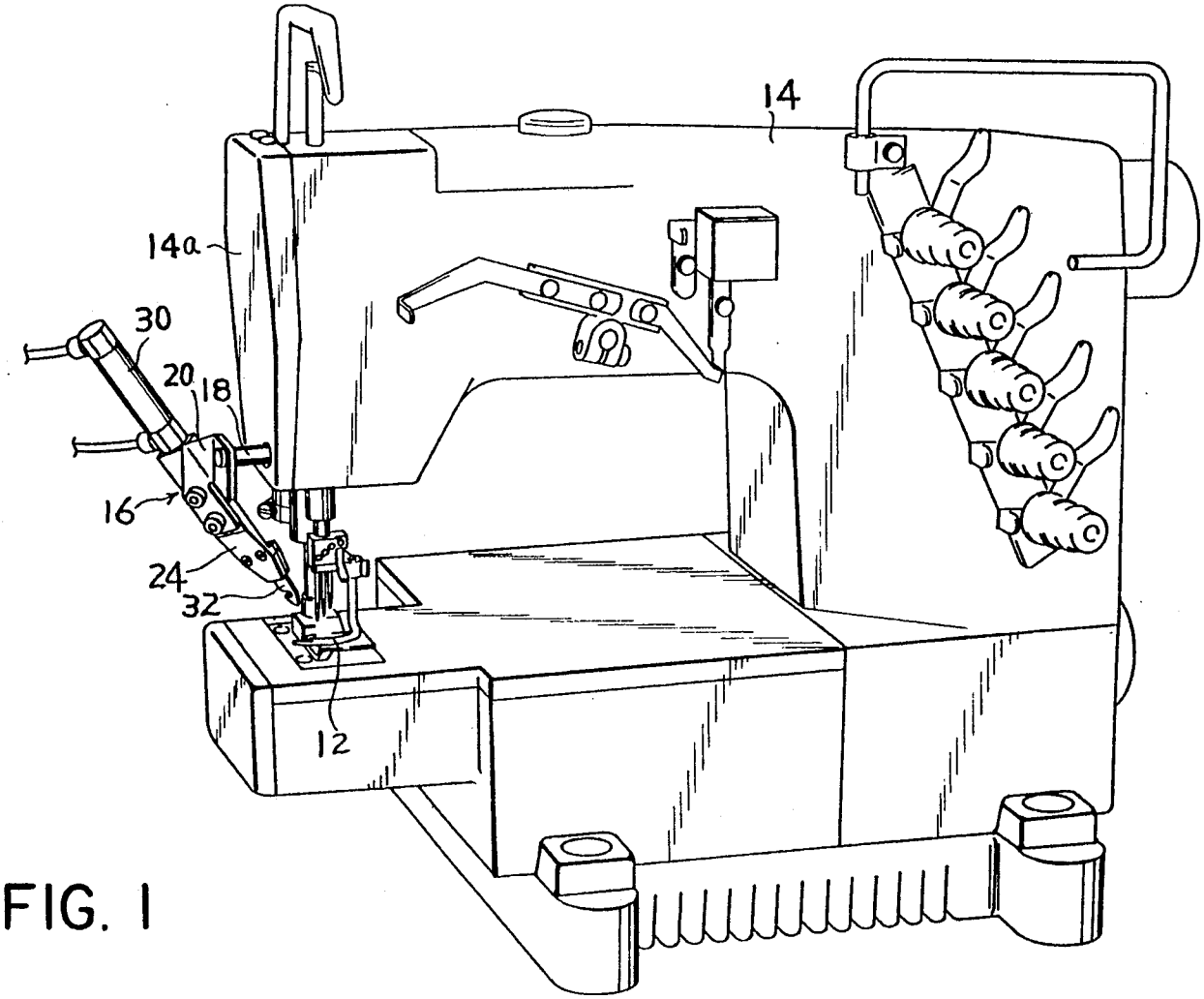
FIG. 1 is a prespective view of a flat sewing machine with a cover thread cutter.

FIG. 1 shows a flat sewing machine with a needle home position stopping device, in which a curved cover thread laying finger 12 reciprocates laterally from a right end point in front of the needle, captures, at a first position, and pulls the cover thread in the fore stroke, and releases the cover thread in the returning stroke after reaching its left dead center, and a cover thread cutter 16 is installed at the lower left side of the head 14*a* of the sewing machine 14.

Figure 5:
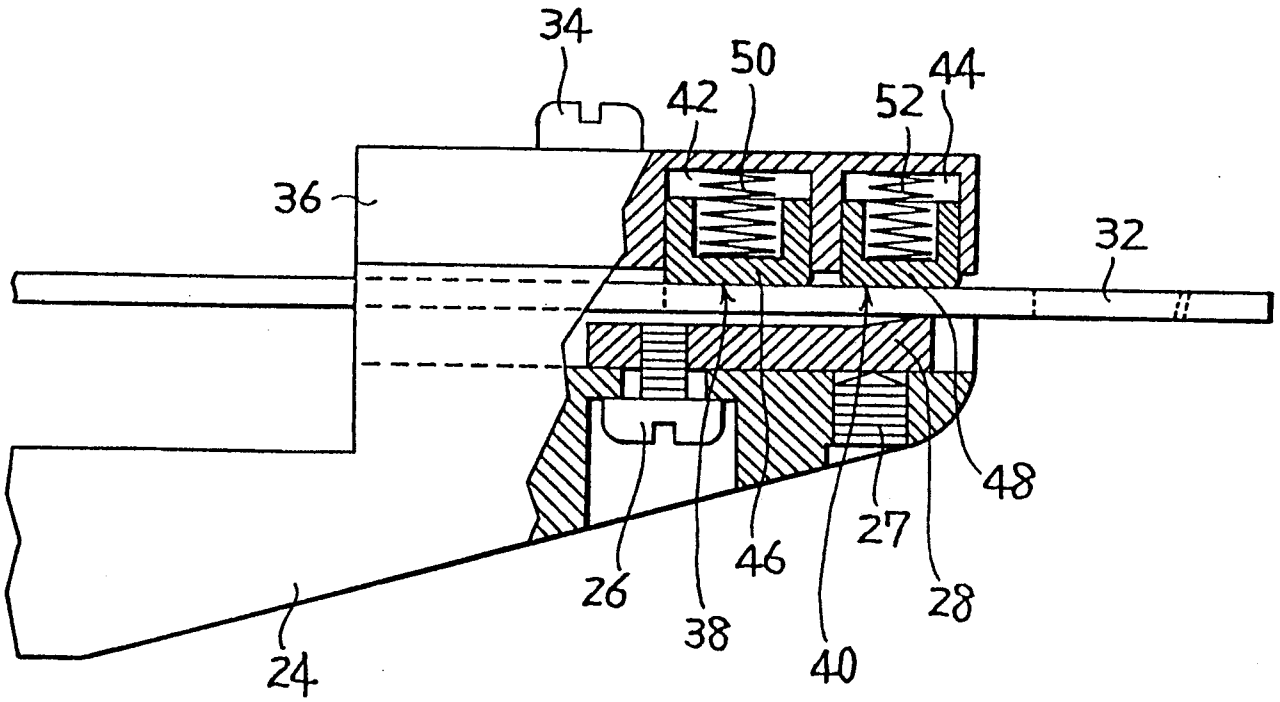
FIG. 5 is a partial sectional side view of essential parts of the thread cutter.
Figure 6:
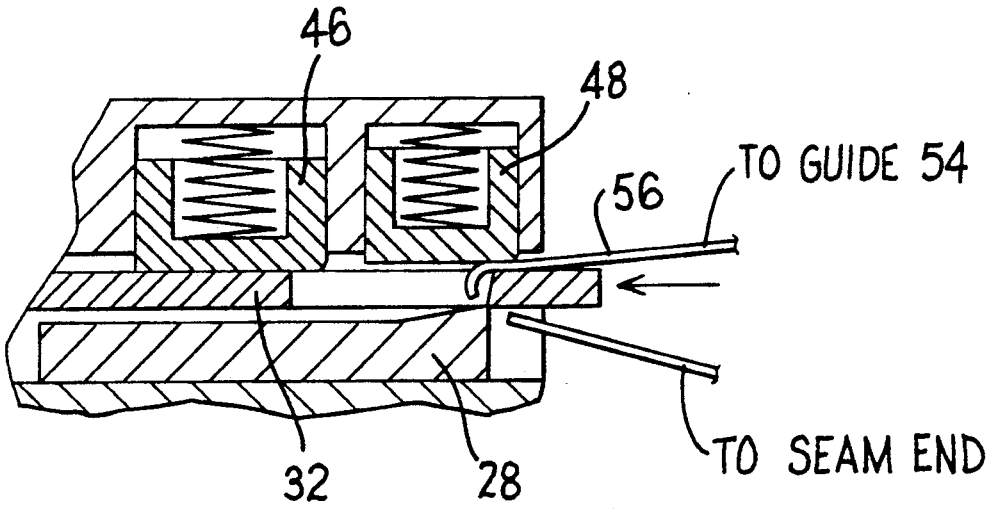
FIG. 6 is a partial sectional side view showing the cover thread being cut.

The cover thread cutter 16 comprises a bracket 20 which is mounted on a support shaft 18 and projects laterally from the head 14*a*, a cutter support frame 24 attached by screws 22 to the bracket 20 so as to be directed at an oblique angle downward to the left side of the left needle N1, a fixed cutter 28 attached by screw 26 to the front end of the cutter support frame 24 and having its blade tip adjusted vertically by an adjusting screw 27, as shown in FIG. 5, a hook 32 of the thread cutter 16 which is supported by an air cylinder 30 mounted on the cutter support frame 24 and slidingly moves back and forth along the fixed cutter 28 at an oblique from behind the left side of the left needle N1 to in front of the needles N1, N2 by the operation of the air cylinder 30, a holder 36 which secures the hook 32 of the thread cutter 16 to the frame 24 and is attached to the cutter support frame 24 by setscrews 34, a first spring device 38 mounted in the holder 36 for tightly pressing the hook 32 of the thread cutter 16 towards the fixed cutter 28, and a second spring device 40 mounted in the holder 36 for lightly and elastically contacting with the hook 32 so as to lightly hold the cut end of the cover thread with the minimum pressing pressure required. The second spring device is positioned at the more forward end of the hook 32 of the thread cutter 16 than the first spring device 38 and the first and second spring devices 38 and 40 are composed of spring retainers 46 and 48 which engage with recesses 42 and 44 arranged in the holder 36 and are of a circular or square cap form. The surface contacting with the hook 32 of the thread cutter 32 is a flat plane so as to enhance the holding force, and coil springs 50 and 52, which are set in the recesses 42 and 44, are pressed by the spring retainers 46 and 48. The coil spring 50 of the first spring device 38 has a strong spring force, while the coil spring 52 of the second spring device 40 is designed to have a weak spring force. The first spring device 38 is larger in size than the second spring device 40 so as to be easily distinguished from the second spring device 40 during assembling. For easier identification, different colors, numbers or codes may be used.

The hook 32 of the thread cutter 16 which is drawn back by the operation of the air cylinder 30, extends above the curved cover thread laying finger 12 when moved forward, and when the hook retracts, the hook 32 of the thread cutter 32 is designed to capture the cover thread 56 extending from the hook 13 of the curved cover thread laying finger 12 to the cover thread guide 54, at the left side of the left needle N1 near the hook 13. A notch hole 58 is formed in the finger 12 so as to prevent a collision with the hook for thread cutter 16 and the finger 12 when the hook 32 of the thread cutter 16 is moved forward.

In the drawing, numeral 60 is a cover thread movable guide attached to a needle holder 62. Numeral 64 is a needle thread, and 66 is a presser foot.

In this device composed as described herein, cutting of the cover thread and holding of the thread end are operated as follows.

Figure 2:
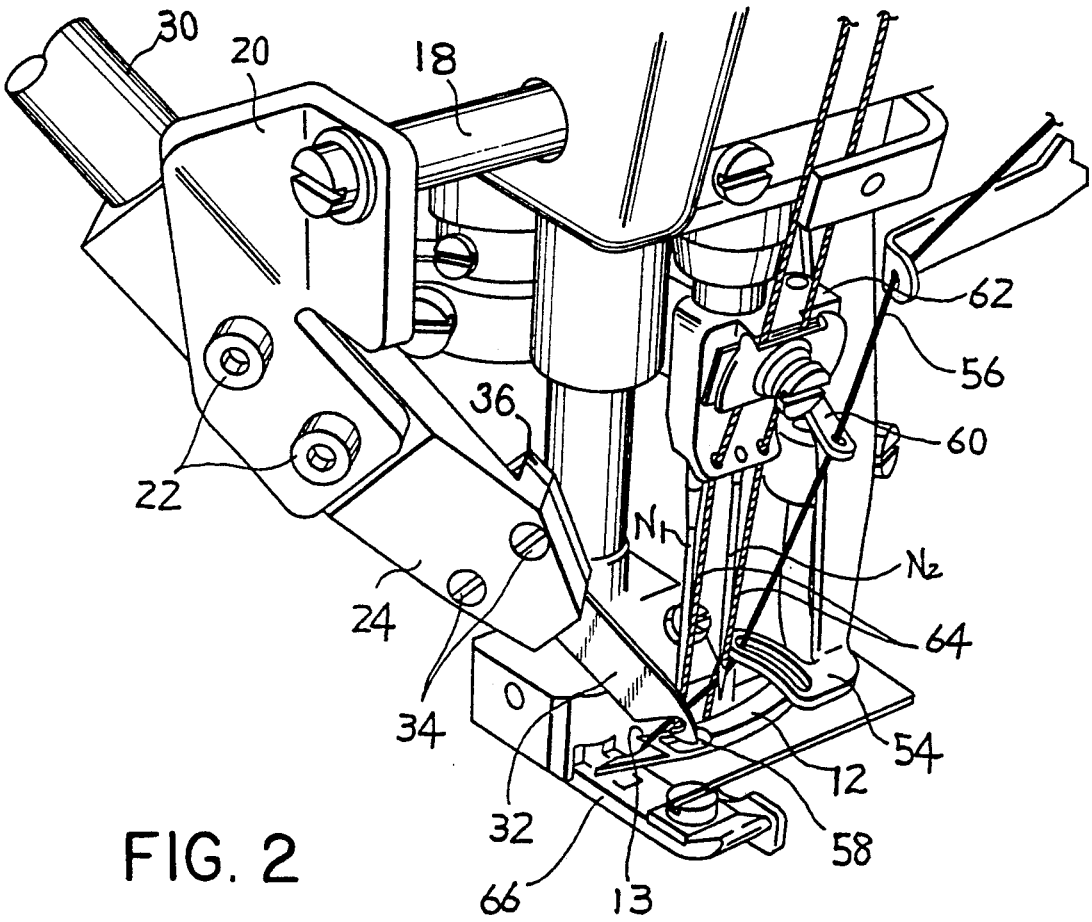
FIG. 2 is a perspective view when the hook of the thread cutter is advanced above the curved cover thread laying finger at the time of capturing the cover thread.
Figure 3:
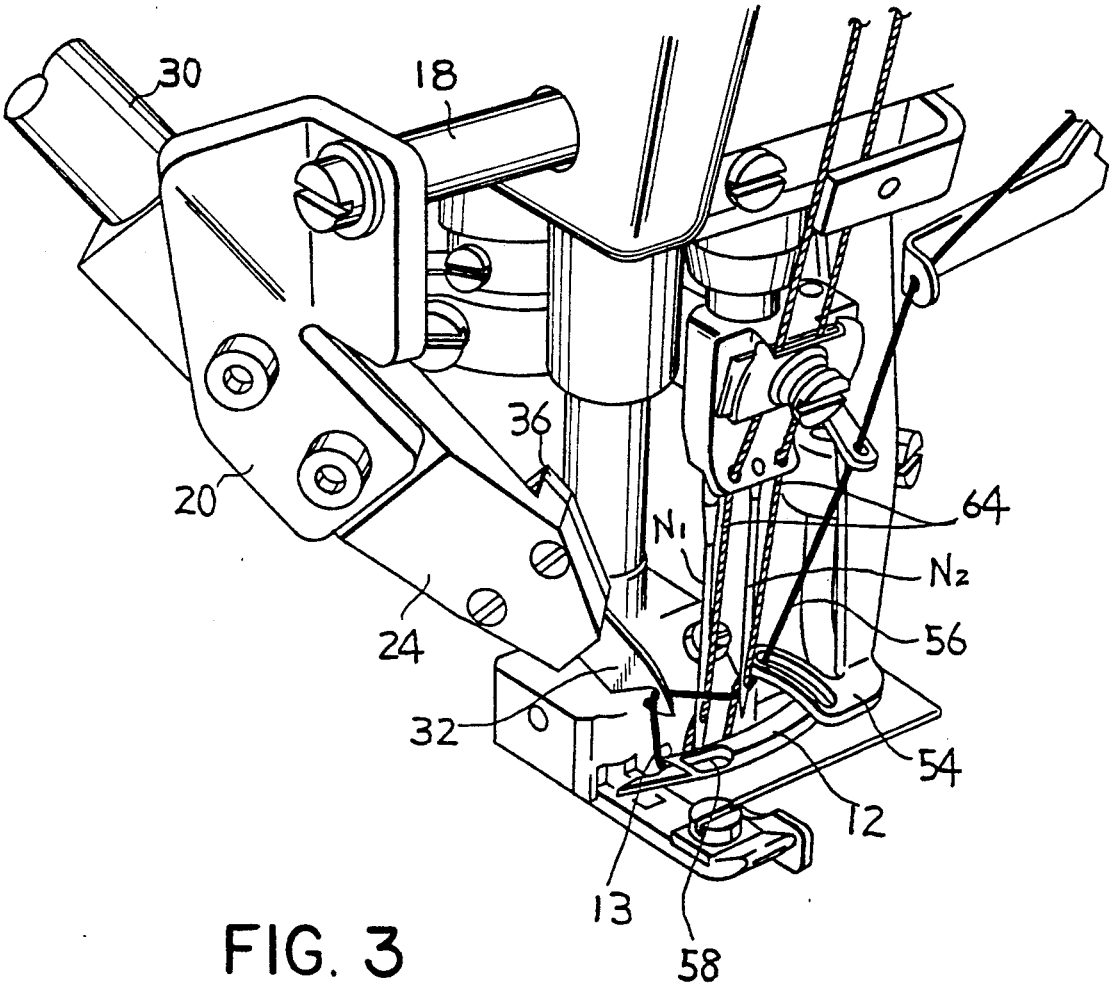
FIG. 3 is a perspective view showing the state of pulling the cover thread by the hook towards the thread cutter.
Figure 4:
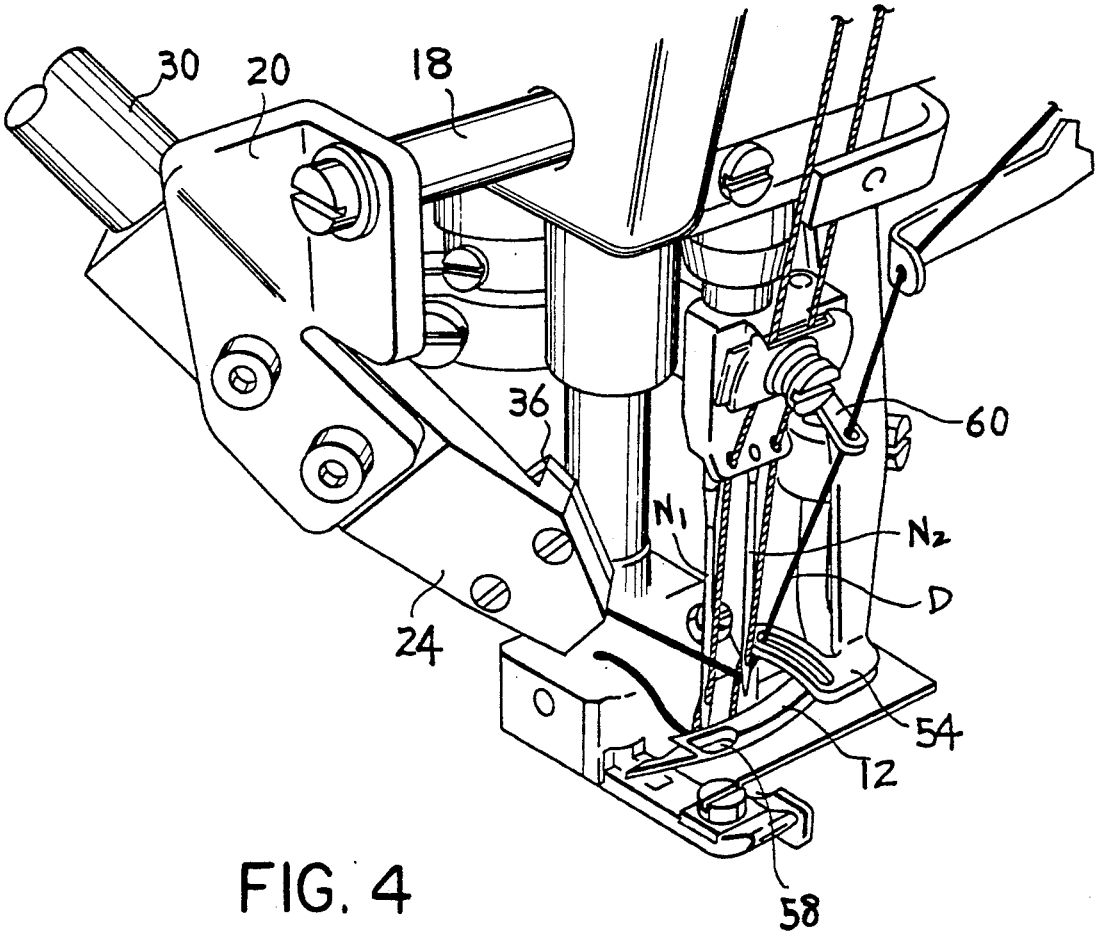
FIG. 4 is a perspective view showing the cut-off state of the cover thread.

When the sewing is over and the pedal (not shown) is released by the operator, the needles N1, N2 are stopped at the top end point, while the curved cover thread laying finger 12 stops at the left end point in the state of caputuring and pulling the cover thread. In sequence, by the operation of the air cylinder, the hook 32 of the thread cutter 16 is extend forward at an oblique angle from behind the left side of the left needle N1. When the front end of the hook 32 of the thread cutter 16 reaches a second position above the curved cover thread laying finger, it is then drawn back rearward. The hook of the thread cutter 16 captures the cover thread 56 between the hook 13 and the cover thread guide 54 (FIG. 2) and pulls it back at an oblique angle to the left side (FIG. 3). At this time, the cover thread 56 is placed between the left needle N1 and the right needle N2, and is caught on the left needle N1 and is bent backward obliquely towards the left. When the hook 32 of the thread cutter 16 pulls the cover thread 56 against the fixed cutter 28, the thread 56 is cut off, and the cut thread end of the thread supply source is pinched between the second spring device 40 and the hook 32 of the thread cutter 32. In this state, the cover thread 56 is hooked on the right needle N2 at its downstream side and is hooked on the left needle N1 at its upstream, so that the cover thread is sewn into the first needle thread seam when starting the next sewing work.

What is claimed is:

1. A method of cutting a cover thread of a multineedle sewing machine, said sewing machine comprising a left side needle, a right side needle, a curved cover thread laying finger, a thread cutter with a hook, a fixed cutter and a cover thread guide provided above the curved cover thread laying finger, said method comprising the steps of:

providing said hook at a cutting position above and downstream of the curved cover thread laying finger, said hook being extendible from and retractable to said cutting position;

capturing the cover thread with the curved cover thread laying finger at a first position and laterally moving the curved cover thread laying finger with the captured cover thread to a left end point, said captured cover thread extending between said curved cover thread laying finger and said cover thread guide;

stopping the needles at or near a top end point and said curved cover thread laying finger at or near the left end point;

extending said hook from said cutting position downwardly along an angle being oblique to a plane containing said curved cover thread laying finger and below an uppermost surface of said curved cover thread laying finger until said captured cover thread above the curved cover thread laying finger is ensnared by said hook;

retracting said hook and said cover thread ensnared by said hook upward along said oblique angle to said cutting position, said cover thread being pulled downstream of the right side needle and upstream of the left side needle;

cutting said cover thread at said cutting position with said fixed cutter in cooperation with said hook; and holding one end of the cut cover thread at said cutting position.

2. A method of cutting a cover thread of a multineedle sewing machine, said sewing machine comprising a left side needle, a right side needle, a curved cover thread laying finger with a hooked end, a thread cutter with a hook, a fixed cutter and a cover thread guide provided above the curved cover thread laying finger, said method comprising the steps of:

providing said hook at a cutting position above and downstream of said curved cover thread laying finger, said hook being extendible from and retractable to said cutting position;

capturing the cover thread with the hooked end of the curved cover thread laying finger at a first position and laterally moving the hooked end of the curved cover thread laying finger with the captured cover thread to a left end point so that said captured cover thread extends from the left end point at the hooked end of the curved cover thread laying finger to said cover thread guide, said captured cover thread running upstream of the left side needle and downstream of the right side needle;

stopping the needles at or near a top end point and said curved cover thread laying finger at or near the left end point;

extending said hook from said cutting position downwardly along an angle being oblique to a plane containing said curved cover thread laying finger and below an uppermost surface of said curved cover thread laying finger until said captured cover thread above the curved cover thread laying finger is ensnared by said hook;

retracting said hook and said cover thread ensnared by said hook along said oblique angle to said cutting position, said cover thread being pulled downstream of said right side needle and upstream of said left side needle;

cutting said cover thread at said cutting position with said fixed cutter in cooperation with said hook; and holding one end of said cut cover thread with said hook in cooperation with a holding device so that said cover thread is maintained at a position downstream of the right side needle and upstream of the left side needle.

3. A cover thread cutter of a multi-needle sewing machine comprising a left side needle and a right side needle, said needles being mounted for reciprocating vertical movement between top end points and bottom end points; a cover thread guide and a curved cover thread laying finger provided below the cover thread guide, said curved cover thread laying finger being mounted for reciprocating lateral movement between a first position for capturing the cover thread and a left end point where the captured cover thread extends between said curved cover thread laying finger and said cover thread guide, said cover thread cutter comprising:

a fixed cutter, said fixed cutter being provided at a cutting position above and downstream of said curved cover thread laying finger;

a thread cutter with a hook, said hook being mounted for sliding reciprocating movement along said fixed cutter between said cutting position and a second position where said hook extends below an uppermost surface of said curved cover thread laying finger and ensnares said captured cover thread from above said curved cover thread laying finger, said sliding reciprocating movement also being along an angle being oblique to a plane containing said curved cover thread laying finger; and a first spring device for biasing the hook towards the fixed cutter.

4. A cover thread cutter of a multi-needle sewing machine according to claim 3, wherein the curved cover thread laying finger has an opening provided therein, the hook of the thread cutter entering said opening so as to avoid a collision between the curved cover thread laying finger and the hook of the thread cutter.

5. A cover thread cutter of a multi-needle sewing machine according to claim 3, wherein in addition to the first spring device for biasing the hook of the thread cutter towards the fixed cutter, the cover thread cutter further comprises a second spring device for holding the cut thread end in cooperation with the hook of the thread cutter by lightly and elastically contacting the hook of the thread cutter, the first and second spring devices both being composed of coil springs and spring retainers, the second spring device having a weaker coil spring force than the first spring device and being disposed forward of the first spring device in the cover thread cutter.

6. A cover thread cutter of a multi-needle sewing machine according to claim 5, wherein the spring retainer is shaped like a cap and contacts the hook of the thread cutter by a flat plane surface.

7. A cover thread cutter of a multi-needle sewing machine according to claim 5, wherein the first spring device and second spring device differ in size.

* * * * *